US005649642A

United States Patent [19]

Mabry et al.

[11] Patent Number: 5,649,642

[45] Date of Patent: Jul. 22, 1997

[54] DISPENSER FOR CHEWING GUM OR BUBBLE GUM

[76] Inventors: Hellen Mabry, 852 W. Beach Ave., Apt. #3, Inglewood, Calif. 90032; John W. Thomas, 4001 Greenridge Rd., Apt. #201, Pittsburgh, Pa. 15234; Steven D. Goldenbogen, 733 Broughton St., Apt. #2, Pittsburgh, Pa. 15213; David L. Volk, 301 Oakwood Ct., Clairton, Pa. 15025

[21] Appl. No.: 526,685

[22] Filed: Sep. 11, 1995

[51] Int. Cl.[6] ..... B65H 1/08

[52] U.S. Cl. ..... 221/232; 221/268

[58] Field of Search ..... 221/232, 226, 221/268, 255, 272, 270, 279; 206/800

[56] References Cited

U.S. PATENT DOCUMENTS

| | | | |
|---|---|---|---|
| D. 249,471 | 9/1978 | Stern | D9/235 |
| D. 249,931 | 10/1978 | Russert | D9/224 |
| D. 249,932 | 10/1978 | Russert | D9/224 |
| 2,591,855 | 4/1952 | Nicholson | 221/232 |
| 3,393,831 | 7/1968 | Stewart | 221/232 |
| 4,194,632 | 3/1980 | Dutcher | 206/626 |
| 4,465,208 | 8/1984 | Buban et al. | 221/279 |
| 4,779,759 | 10/1988 | Seavey | 221/232 |
| 5,056,683 | 10/1991 | O'Brien et al. | 221/64 |
| 5,353,956 | 10/1994 | Wilson | 221/198 |

*Primary Examiner*—Kenneth Noland

*Attorney, Agent, or Firm*—David L. Volk; Brendan B. Dix

[57] ABSTRACT

A gum dispenser includes a substantially rectangular, box shaped container having a platform therein. The platform is disposed substantially parallel to a first wall and a second wall of the container. When sticks of gum are positioned between the platform and the second wall of the container, a spring urges the platform against the sticks of gum, and a leading stick of gum is urged against the second wall of the container. The second wall of the container includes a track, with an operator slidably engaged therein. When a user slides the operator toward a slot in the lid of the dispenser, a seat of the operator engages a short edge of the leading stick of gum and pushes the gum partially through the slot, thereby dispensing the gum. The container further includes a base with a notch therein for limiting movement of the operator in a direction away from the lid, so that the operator remains engaged within the track. The dispenser is preferably constructed of plastic or other suitable, rigid, non-permeable material.

4 Claims, 4 Drawing Sheets

DISPENSER FOR CHEWING GUM OR BUBBLE GUM

BACKGROUND—FIELD OF INVENTION

This invention relates to dispensers for chewing gum or bubble gum, specifically to personal dispensers for stick gum.

BACKGROUND—DESCRIPTION OF PRIOR ART

Personal dispensers for chewing gum or bubble gum are known in the prior art. U.S. Pat. No. 4,465,208 to Buban, et al. discloses a dispenser with a cover whose central region is cut away to afford access to a stick of gum which is urged against the cover by a spring-mounted platform. The user dispenses the gum by placing his thumb against the stick of gum and pushing it toward a slot at the end of the dispenser. The gum is susceptible to loss of freshness and to damage from moisture or foreign objects due to the exposure of the gum through the cut away region.

U.S. Pat. No. 5,056,683 to O'Brien et al. discloses a cardboard dispenser with a paper sling which extends from the inside of the dispenser through the dispensing slot. As the user pulls on the sling, a stick of gum is carded by the sling through the slot. Because this container is made of cardboard, the gum contained within is more susceptible to moisture damage than it would be in a container constructed of a non-permeable material, such as plastic. Additionally, a cardboard container lacks durability. Because the dispenser contains no mechanism such as a spring and platform to urge the gum against a wall of the dispenser, the gum rests loosely within the container and can fall out of the dispensing slot when it is undesirable for it to do so.

U.S. Pat. No. 5,353,956 to Wilson discloses a dispenser with a hinged lid. The user flips open the lid, then slides an ejector with his or her thumb to expose all of the sticks of gum contained in the dispenser at once. The user must then pull the desired stick or sticks of gum away from the other sticks, tap the remaining sticks back into place if they have become dislodged by the action of pulling away the desired sticks, then close the lid.

OBJECTS AND ADVANTAGES

Accordingly, several objects and advantages of the present invention are:

(a) to provide a gum dispenser which helps to protect the gum from damage from moisture or foreign objects;

(b) to provide a gum dispenser which prolongs the freshness of the gum;

(c) to provide a gum dispenser which is durable;

(d) to provide a gum dispenser which securely contains the gum so that it will not fall out of the dispenser when it is undesirable for it to do so; and (e) to provide a gum dispenser which dispenses a single piece of gum at a time.

SUMMARY

The gum dispenser of the present invention includes a substantially rectangular box shaped container having a first and second wall, the walls being substantially opposed and parallel to each other. The container includes a platform therein, the platform being substantially parallel to the first and second walls of the container.

One end of a spring within the container is mounted to a first wall of the container, and the other end of the spring is mounted to the platform. When sticks of gum are placed between the platform and the second wall of the container, the spring urges the platform against the sticks of gum, and a leading stick of gum is urged against the second wall of the container.

The dispenser includes a lid with a slot through which the gum is dispensed. The second wall of the container includes a track. An operator includes a plate, the plate being slidably engaged within the track. The operator further includes a seat which is positioned adjacent to a short edge of the leading stick of gum when the leading stick of gum is urged against the second wall of the container.

When a user slides the operator toward the lid, the seat engages the short edge of the leading stick of gum and pushes the gum partially through the slot, thereby dispensing the gum.

The container includes a base with structure forming a notch therein. The notch is configured to engage the operator when the operator is in a retracted position, thereby limiting travel of the operator in the plane of the second wall in a direction away from the lid, so that the plate remains engaged within the track.

The dispenser is preferably made of plastic or other rigid, non-permeable material.

Because the only fixed opening in the dispenser is the slot, the dispenser helps to protect the gum from damage from moisture or foreign objects, and the freshness of the gum is prolonged. Because the dispenser is constructed of plastic or other rigid, non-permeable material, the dispenser is durable and helps to protect the gum from moisture damage. Because the gum is securely urged against a wall of the dispenser, the gum will not fall out of the dispenser when it is undesirable for it to do so. Because the seat of the operator engages only the short edge of the leading stick of gum, only one stick of gum is dispensed at a time.

REFERENCE NUMERALS USED IN DRAWINGS

| | | | |
|---|---|---|---|
| 10 | Container | 12 | First Wall (of container) |
| 14 | Second Wall (of container) | 16 | Platform |
| 18 | Spring | 20 | First End (of spring) |
| 22 | Second End (of spring) | 24 | Sticks of Gum |
| 26 | Leading Stick of Gum | 28 | Lid |
| 30 | Slot | 32 | Track |
| 34 | Operator | 36 | Plate |
| 38 | Seat | 40 | Short Edge (of leading stick of gum) |
| 42 | Base | 44 | Notch |

DESCRIPTION OF THE PREFERRED EMBODIMENT

Figure 1:
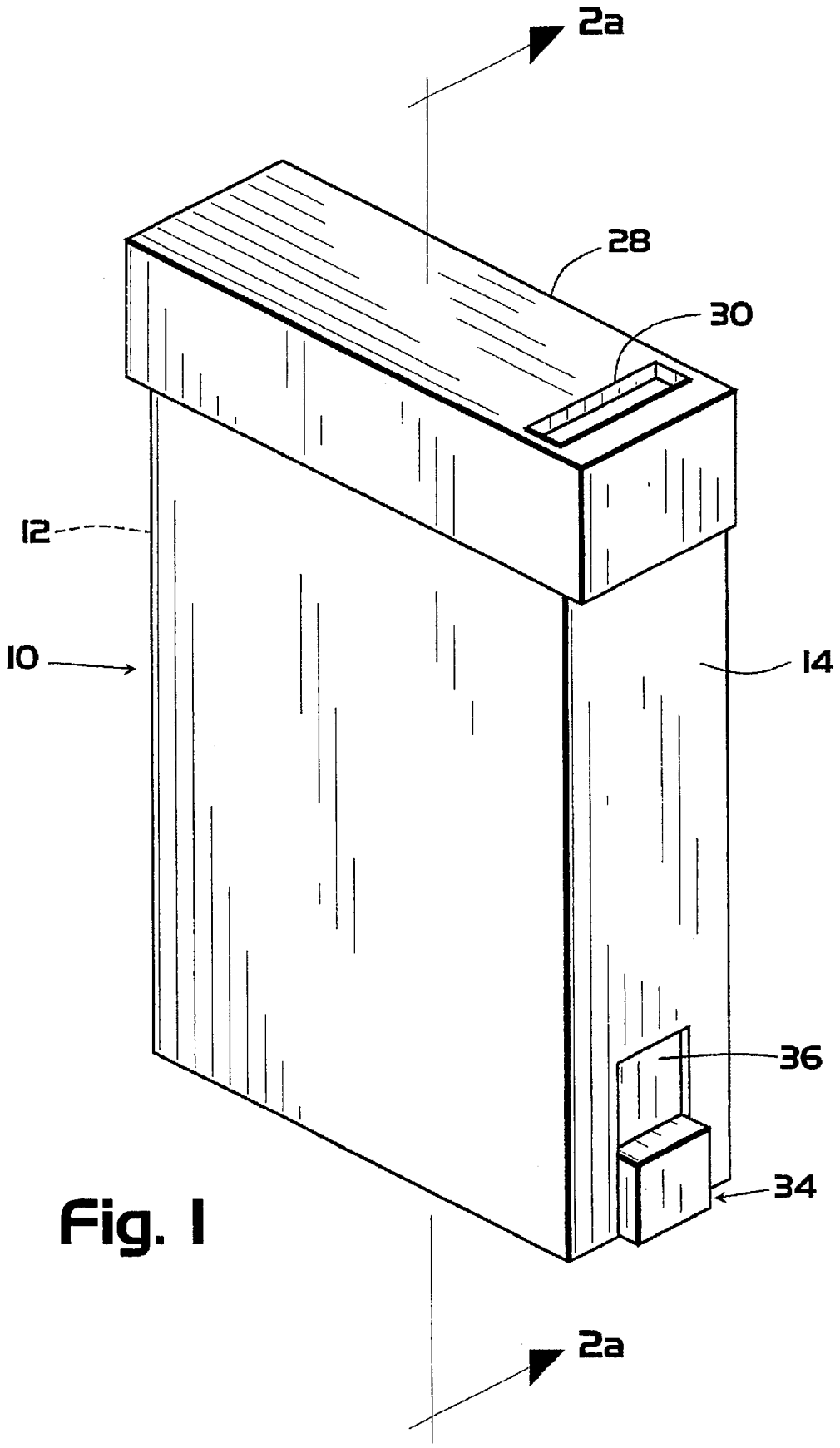
FIG. 1 is a perspective view of the dispenser, with the operator in a retracted position.

FIG. 1 shows a perspective view of the dispenser with an operator 34 in the retracted position. The dispenser consists of a substantially rectangular box shaped container 10 and a removable lid 28. The lid 28 includes structure forming a slot 30 through the lid 28.

Figure 2A:
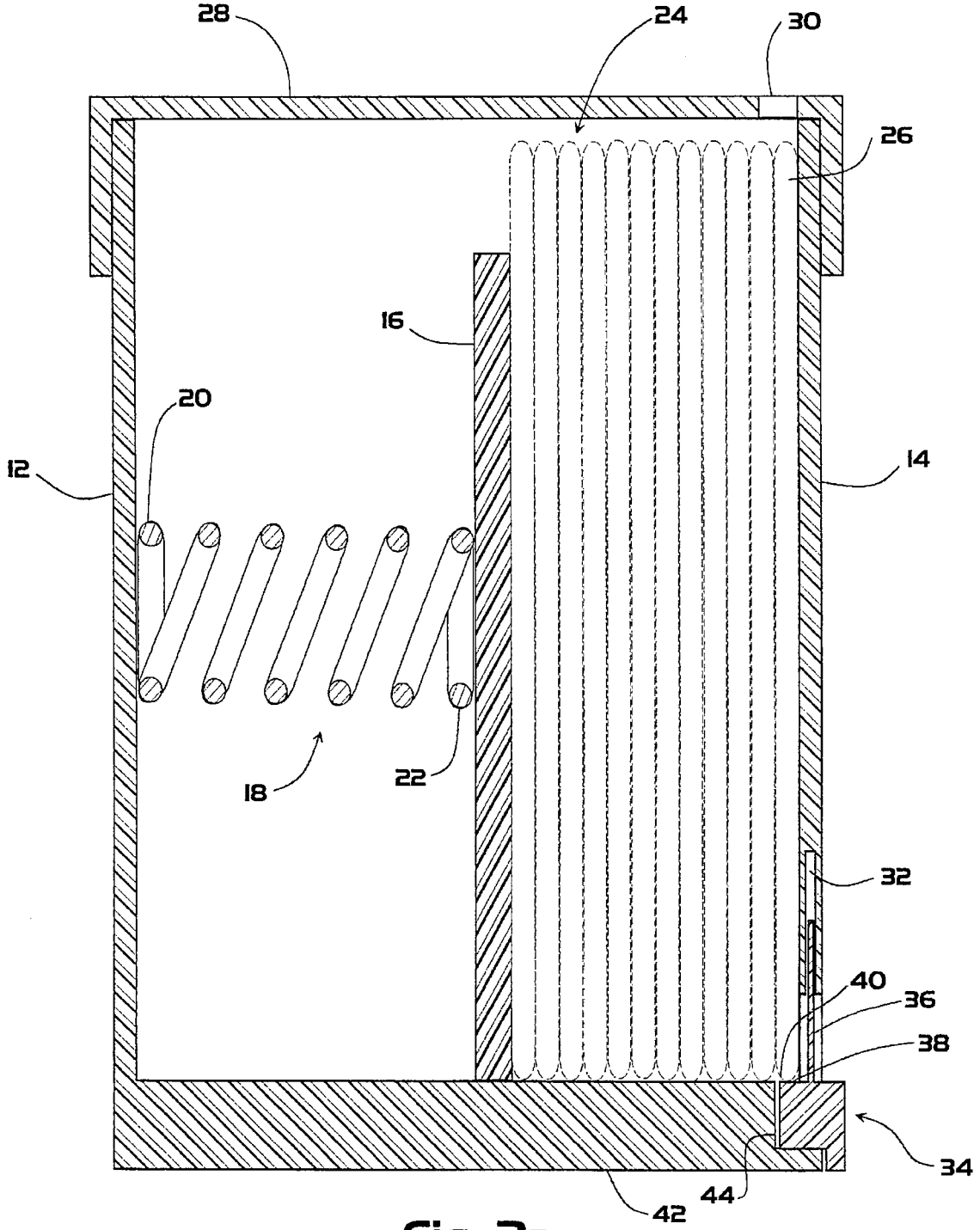
FIG. 2*a* is a cross-sectional view taken along line 2*a*—2*a* of FIG. 1.

FIG. 2*a* shows a cross-sectional view of the dispenser, taken along line 2*a*—2*a* of FIG. 1. A first wall 12 and a second wall 14 of container 10 are positioned substantially opposed and parallel to each other. A spring 18 within container 10 has a first end 20 fixedly attached to first wall 12 of container 10. A second end 22 of spring 18 is fixedly attached to a platform 16. Platform 16 is disposed substantially parallel to first wall 12 and second wall 14 of container 10. When sticks of gum 24 are positioned within the container 10 between the platform 16 and the second wall 14 of container 10, spring 18 urges platform 16 against the sticks of gum 24, and a leading stick of gum 26 is urged against second wall 14.

Figure 3:
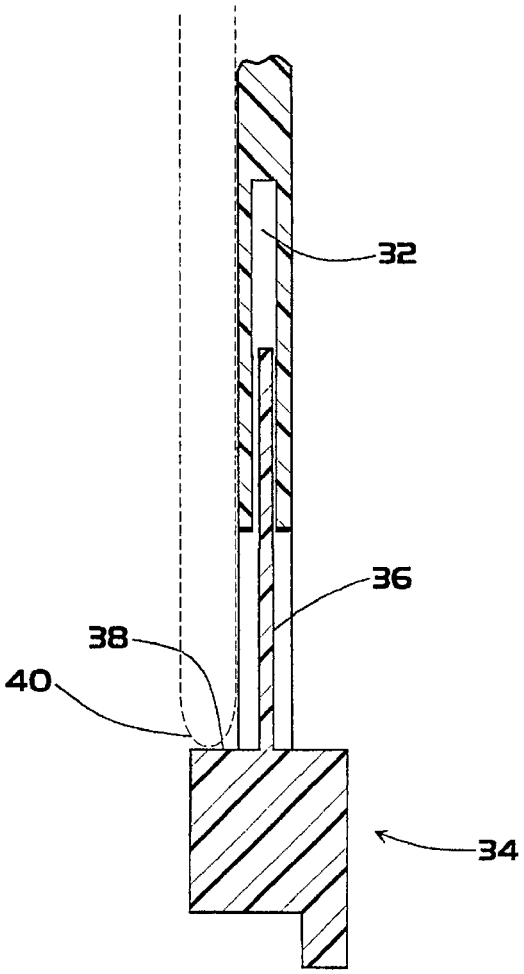
FIG. 3 is an enlarged partial view of FIG. 2*a*, showing the operator and track.
Figure 4:
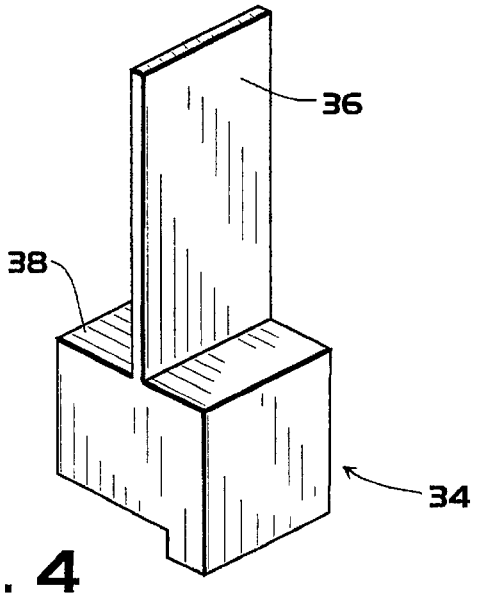
FIG. 4 is an enlarged perspective view of the operator, separated from the rest of the dispenser for clarity.

FIG. 3 is an enlarged partial view of FIG. 2*a*. FIG. 4 is an enlarged perspective view of the operator 34. Referring to FIGS. 2*a*, 3 and 4, the second wall 14 of container 10 includes structure forming a track 32 within the second wall 14. The operator 34 includes a plate 36. The plate 36 is slidably engaged within the track 32. Operator 34 includes a seat 38 which is positioned adjacent to a short edge 40 of the leading stick of gum 26 when leading stick of gum 26 is urged against the second wall 14 of container 10.

The container 10 includes a base 42, base 42 having structure forming a notch 44. Notch 44 is configured to engage the operator 34 when operator 34 is in a retracted position, thereby limiting travel of operator 34 in the plane of second wall 14 in a direction away from lid 28, so that plate 36 remains engaged within track 32.

Figure 2B:
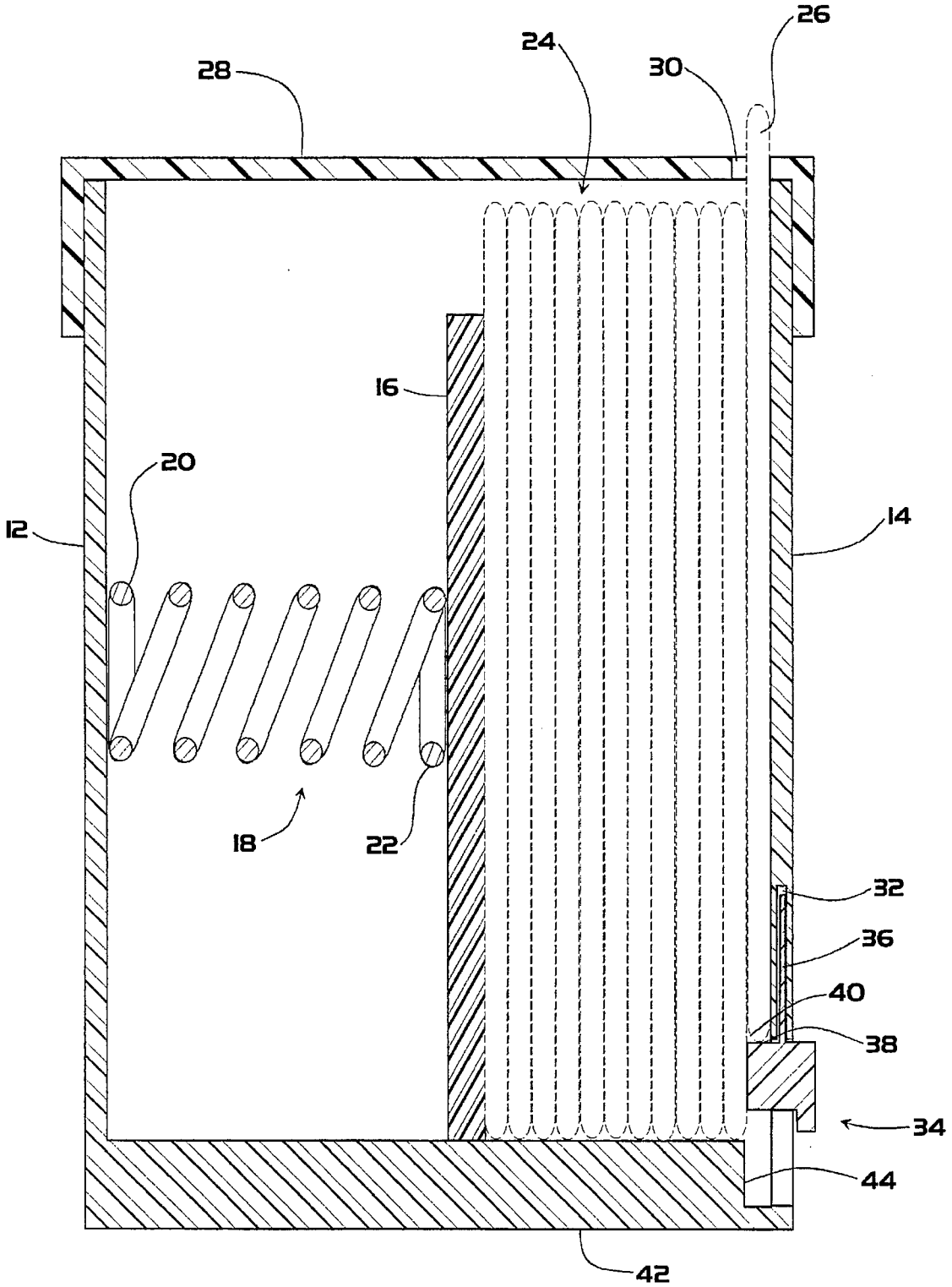
FIG. 2*b* is the same view as FIG. 2*a*, except it shows the operator in a non-retracted position and the leading stick of gum is exposed.

FIG. 2*b* is the same view as FIG. 2*a*, except that it shows the operator 34 in a non-retracted position and the leading stick of gum 26 is exposed. When a user slides the operator 34 toward the lid 28 of container 10, the seat 38 engages the short edge 40 of the leading stick of gum 26 and pushes the leading stick of gum 26 partially through the slot 30.

The dispenser is preferably constructed of plastic or other suitable, rigid, non-permeable material.

CONCLUSION, RAMIFICATIONS AND SCOPE

Thus the dispenser for chewing gum or bubble gum of the present invention helps to protect gum from damage, prolongs the gum's freshness, is durable, securely contains the gum and conveniently dispenses only a single piece of gum at a time.

While the above description contains many specificities, these should not be construed as limitations on the scope of the invention, but rather as an exemplification of one preferred embodiment thereof. Many variations are possible. For example:

(a) the lid may be hinged;

(b) the dispenser could be constructed of brass, tin, or other suitable material;

(c) the operator could be engaged within the second wall of the container by notches and grooves, in addition to or in lieu of the plate and track of the above description, (d) the dispenser may be used to dispense articles other than stick type chewing gum or bubble gum.

Accordingly, the scope of the invention should be determined not by the embodiment illustrated, but by the appended claims and their legal equivalents.

The invention claimed is:

1. A dispenser for chewing gum or bubble gum which protects the gum from moisture or foreign objects and prolongs freshness of the gum, comprising:

a. a substantially rectangular box shaped container having a first wall and a second wall, said first and second walls substantially opposed and parallel to each other, b. a platform within said container, said platform disposed substantially parallel to said first and second walls, c. a spring within said container, said spring having a first end and a second end, d. said first end of said spring fixedly attached to said first wall of said container, said second end of said spring fixedly attached to said platform, such that when sticks of gum are positioned between said platform and said second wall of said container, said spring urges said platform against said sticks of gum and a leading stick of gum is urged against said second wall of said container, e. a lid, said lid being detachable from said container so that gum may be easily inserted into said container, f. said lid having structure forming a slot through said lid, g. an operator, h. said operator slidably engaged within said second wall of said container, i. said operator having a seat, j. said seat positioned adjacent to a short edge of said leading stick of gum when said leading stick of gum is urged against said second wall of said container, such that when a user slides said operator toward said lid of said container, said seat engages said short edge of said leading stick of gum and pushes said leading stick of gum partially through said slot, k. said container having a base, l. said base positioned and configured to abut said operator when said operator is in a retracted position, thereby limiting travel of said operator in the plane of said second wall in a direction away from said lid, so that said operator remains engaged within said second wall.

2. A dispenser for chewing gum or bubble gum which protects the gum from moisture or foreign objects and prolongs freshness of the gum, comprising:

a. a substantially rectangular box shaped container having a first wall and a second wall, said first and second walls substantially opposed and parallel to each other, b. a platform within said container, said platform disposed substantially parallel to said first and second walls, c. a spring within said container, said spring having a first end and a second end, d. said first end of said spring fixedly attached to said first wall of said container, said second end of said spring fixedly attached to said platform, such that when sticks of gum are positioned between said platform and said second wall of said container, said spring urges said platform against said sticks of gum and a leading stick of gum is urged against said second wall of said container, e. a lid, said lid being detachable from said container so that gum may be easily inserted into said container, f. said lid having structure forming a slot through said lid, g. structure forming a track within said second wall of said container, h. an operator including a plate, i. said plate slidably engaged within said track, j. said operator having a seat, k. said seat positioned adjacent to a short edge of said leading stick of gum when said leading stick of gum is urged against said second wall of said container, such that when a user slides said operator toward said lid of said container, said seat engages said short edge of said leading stick of gum and pushes said leading stick of gum partially through said slot, l. said container having a base, m. said base having structure forming a notch, n. said notch configured to engage said operator when said operator is in a retracted position, thereby limiting travel of said operator in the plane of said second wall in a direction away from said lid, so that said plate remains engaged within said track.

3. The dispenser of claim 2 wherein the dispenser is constructed of plastic.

4. The dispenser of claim 2 wherein the dispenser is constructed of a rigid, non-permeable material.

* * * * *